US011976457B1

(12) United States Patent
Tamayo-Oliveros

(10) Patent No.: US 11,976,457 B1
(45) Date of Patent: May 7, 2024

(54) DRAIN PIPE END DEBRIS CAP

(71) Applicant: Eduardo Tamayo-Oliveros, Greensboro, NC (US)

(72) Inventor: Eduardo Tamayo-Oliveros, Greensboro, NC (US)

( * ) Notice: Subject to any disclaimer, the term of this patent is extended or adjusted under 35 U.S.C. 154(b) by 550 days.

(21) Appl. No.: 17/189,402

(22) Filed: Mar. 2, 2021

(51) Int. Cl.
*E03F 5/06* (2006.01)
*E02B 11/00* (2006.01)
*E03F 5/14* (2006.01)

(52) U.S. Cl.
CPC ..... *E03F 5/06* (2013.01); *E02B 11/005* (2013.01); *E03F 5/14* (2013.01)

(58) Field of Classification Search
CPC ..... E03F 5/06; E03F 5/14; E02B 11/005
USPC ..... 138/96
See application file for complete search history.

(56) References Cited

U.S. PATENT DOCUMENTS 1,653,403 A 12/1927 Mccue
4,655,013 A 4/1987 Ritland
5,452,546 A * 9/1995 Goddard ..... E04D 13/08 210/170.03
7,628,565 B2 12/2009 Melegari
8,043,497 B2 10/2011 Silverstein
9,394,661 B2 7/2016 White
11,535,528 B1 * 12/2022 Hakim ..... C02F 1/004
2003/0034286 A1 * 2/2003 Butler ..... E03F 5/0404 210/163
2005/0199537 A1 * 9/2005 Kluge ..... E03F 5/0404 210/164
2005/0247612 A1 * 11/2005 Glassheim ..... E03F 5/0404 210/163
2006/0078387 A1 * 4/2006 Allard ..... E02B 11/005 405/45
2006/0163130 A1 * 7/2006 Happel ..... E03F 5/14 210/163
2007/0034577 A1 2/2007 Bayard
2007/0181486 A1 * 8/2007 Ashliman ..... B01D 29/54 210/485
2008/0035587 A1 * 2/2008 Wieczorek ..... B01D 35/16 210/791
2009/0279954 A1 * 11/2009 Griffith ..... E03F 7/06 405/125
2011/0155672 A1 * 6/2011 McInnis ..... E03F 5/04 210/166
2012/0132581 A1 * 5/2012 Williams ..... B01D 29/66 210/340
2016/0097175 A1 * 4/2016 Parker ..... E03F 1/005 405/184.4

(Continued)

FOREIGN PATENT DOCUMENTS

CA 2862577 3/2015

*Primary Examiner* — David R Deal
(74) *Attorney, Agent, or Firm* — Kyle A. Fletcher, Esq.

(57) ABSTRACT

The drain pipe end debris cap is a mechanical structure. The drain pipe end debris cap is adapted for use in the drainage of soil. The drain pipe end debris cap is a fluid transfer structure that: a) drains water that collects at a collection point; b) transports the drained water underneath the ground; and, c) disperses the drained water into the ground. The drain pipe end debris cap comprises a fluid permeable tubular structure, a filter cap, and a closing cap. The filter cap and the closing caps enclose the open ends of the fluid permeable tubular structure to prevent debris from accumulating within the fluid permeable tubular structure.

14 Claims, 6 Drawing Sheets

(56) References Cited

U.S. PATENT DOCUMENTS

2020/0263409 A1* 8/2020 Spires ..... E03F 1/003
2021/0404168 A1* 12/2021 Singleton ..... E03F 1/00

* cited by examiner

DRAIN PIPE END DEBRIS CAP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of hydraulic engineering including drainage conduits. (E02B11/005)

SUMMARY OF INVENTION

The drain pipe end debris cap is a mechanical structure. The drain pipe end debris cap is adapted for use in the drainage of soil. The drain pipe end debris cap is a fluid transfer structure that: a) drains water that collects at a collection point; b) transports the drained water underneath the ground; and, c) disperses the drained water into the ground. The drain pipe end debris cap comprises a fluid permeable tubular structure, a filter cap, and a closing cap. The filter cap and the closing caps enclose the open ends of the fluid permeable tubular structure to prevent debris from accumulating within the fluid permeable tubular structure.

These together with additional objects, features and advantages of the drain pipe end debris cap will be readily apparent to those of ordinary skill in the art upon reading the following detailed description of the presently preferred, but nonetheless illustrative, embodiments when taken in conjunction with the accompanying drawings.

In this respect, before explaining the current embodiments of the drain pipe end debris cap in detail, it is to be understood that the drain pipe end debris cap is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the drain pipe end debris cap.

It is therefore important that the claims be regarded as including such equivalent construction insofar as they do not depart from the spirit and scope of the drain pipe end debris cap. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
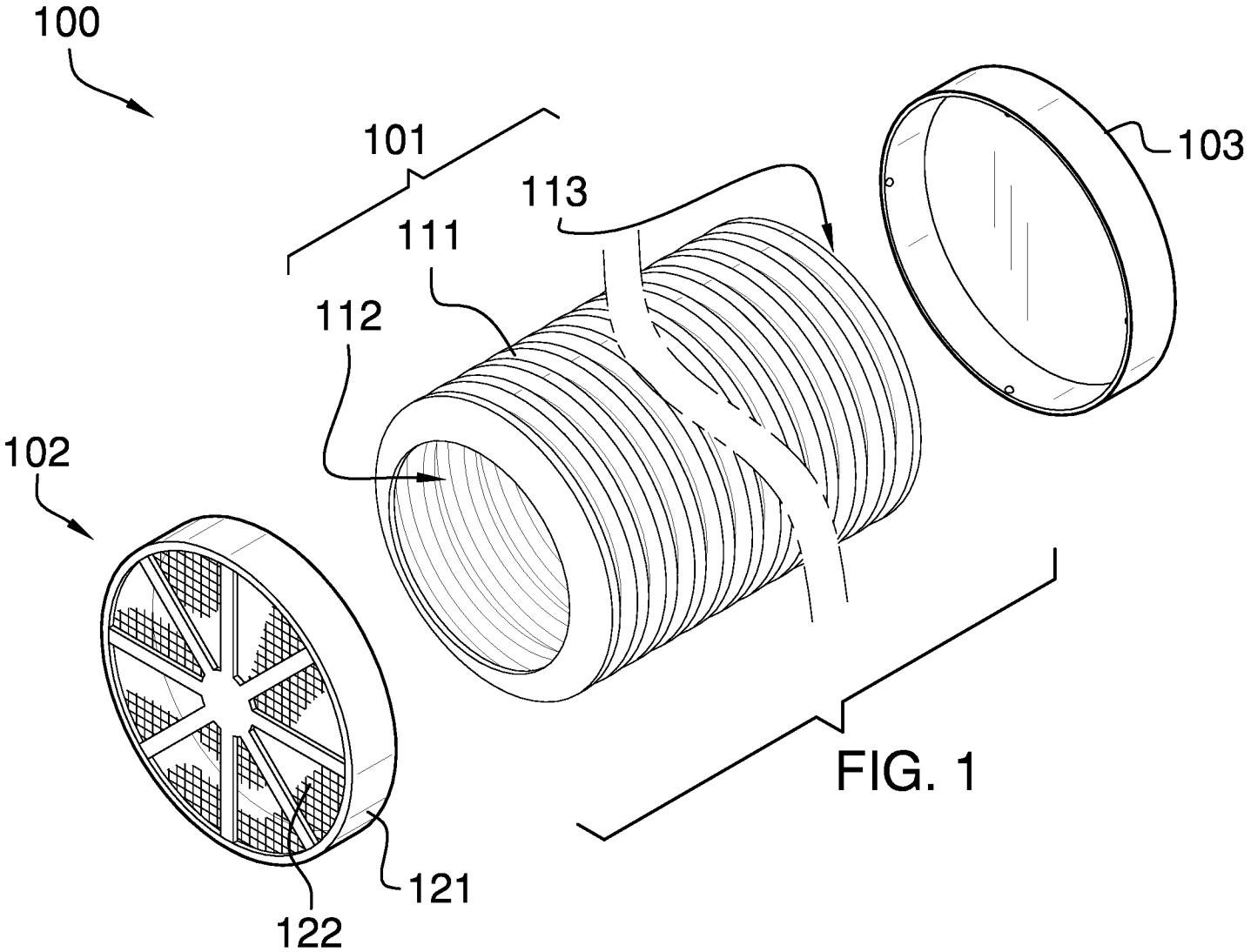
FIG. 1 is a perspective view of an embodiment of the disclosure.
Figure 2:
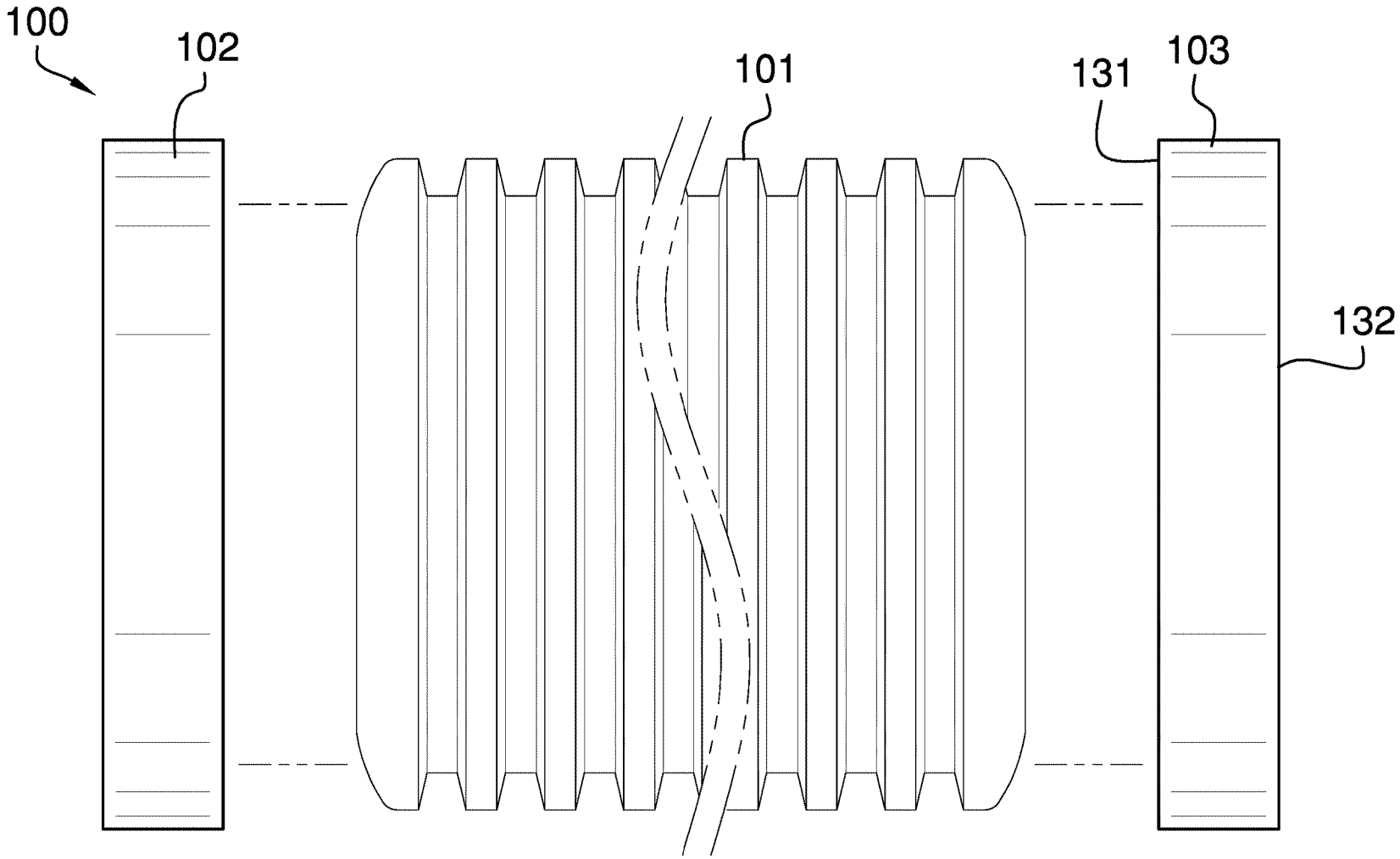
FIG. 2 is a side view of an embodiment of the disclosure.
Figure 3:
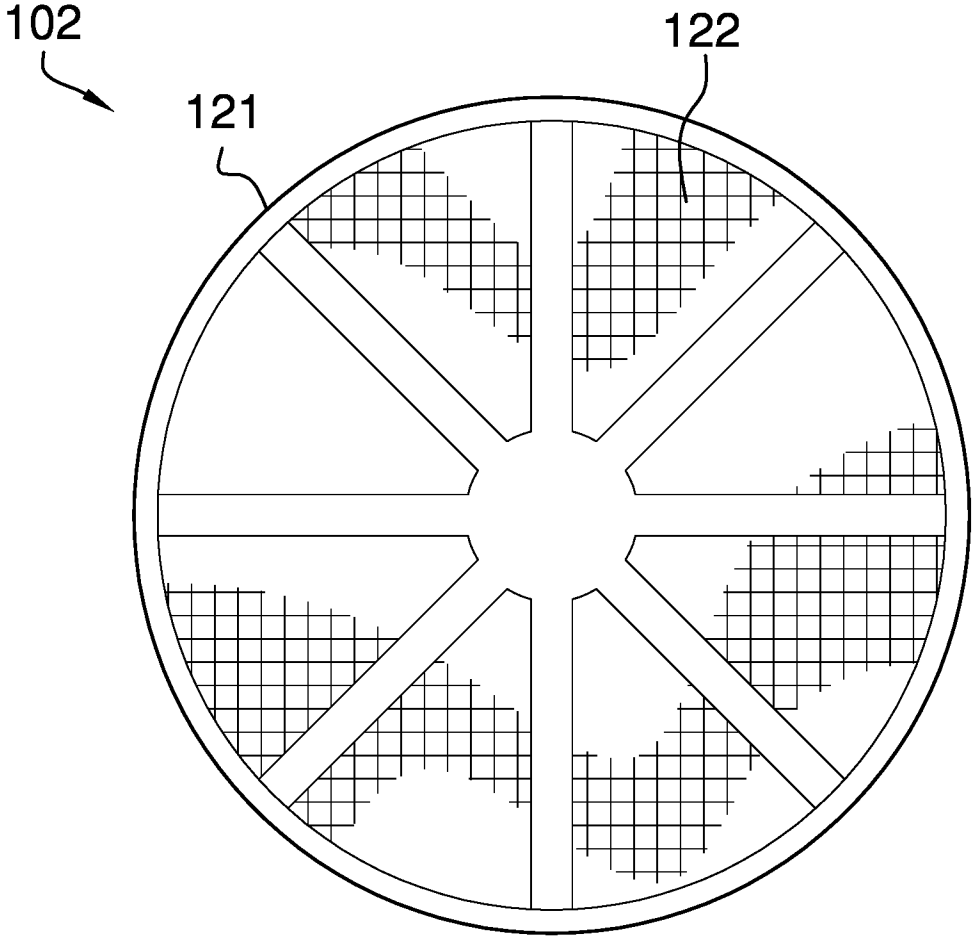
FIG. 3 is a front view of an embodiment of the disclosure.
Figure 5:
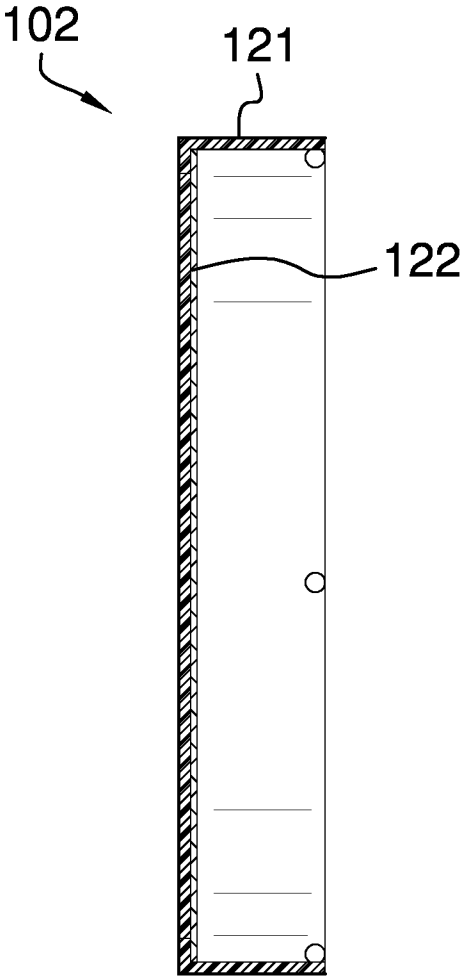
FIG. 5 is a cross-sectional view of an embodiment of the disclosure across 5-5 as shown in FIG. 4.
Figure 4:
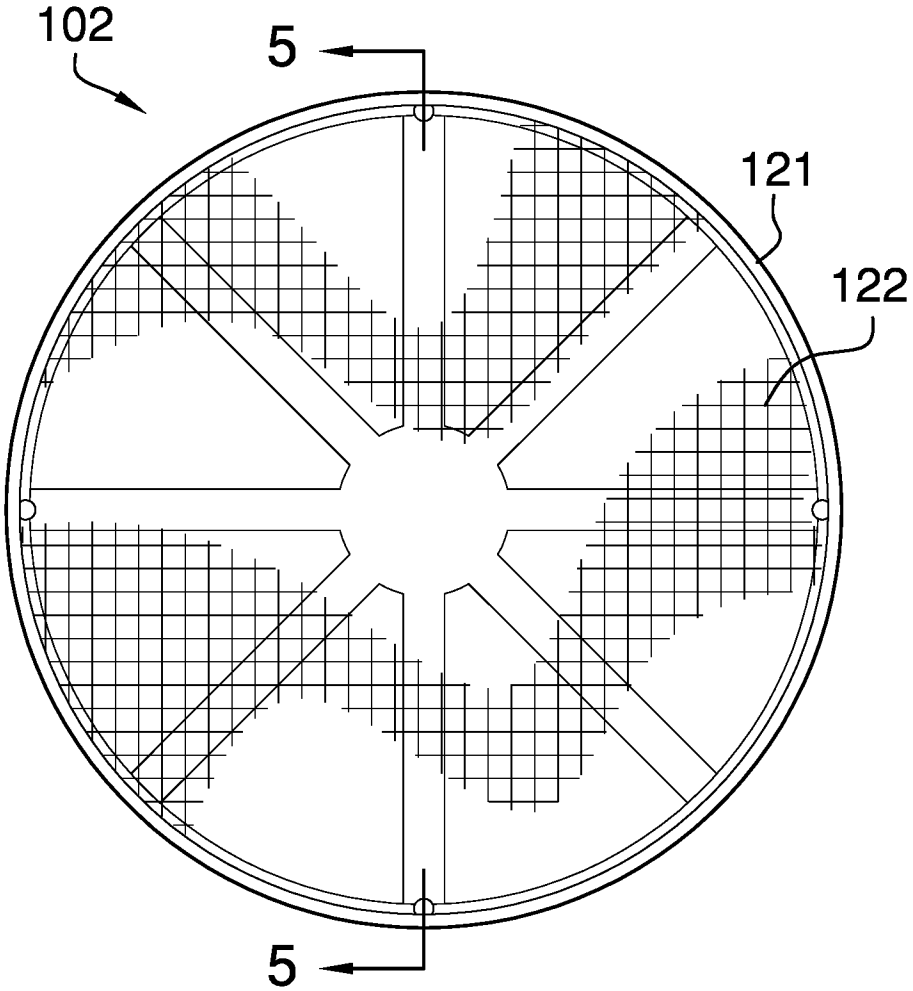
FIG. 4 is a rear view of an embodiment of the disclosure.
Figure 7:
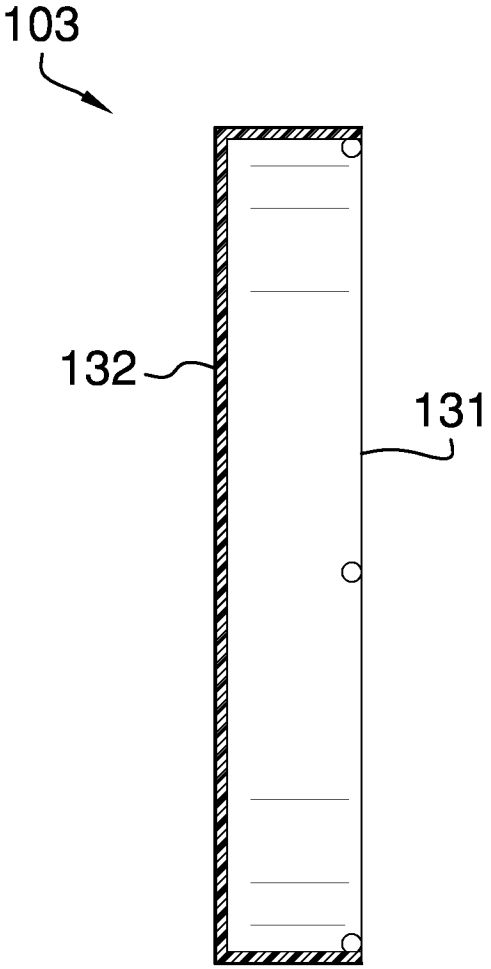
FIG. 7 is a cross-sectional view of an embodiment of the disclosure across 7-7 as shown in FIG. 6.
Figure 6:
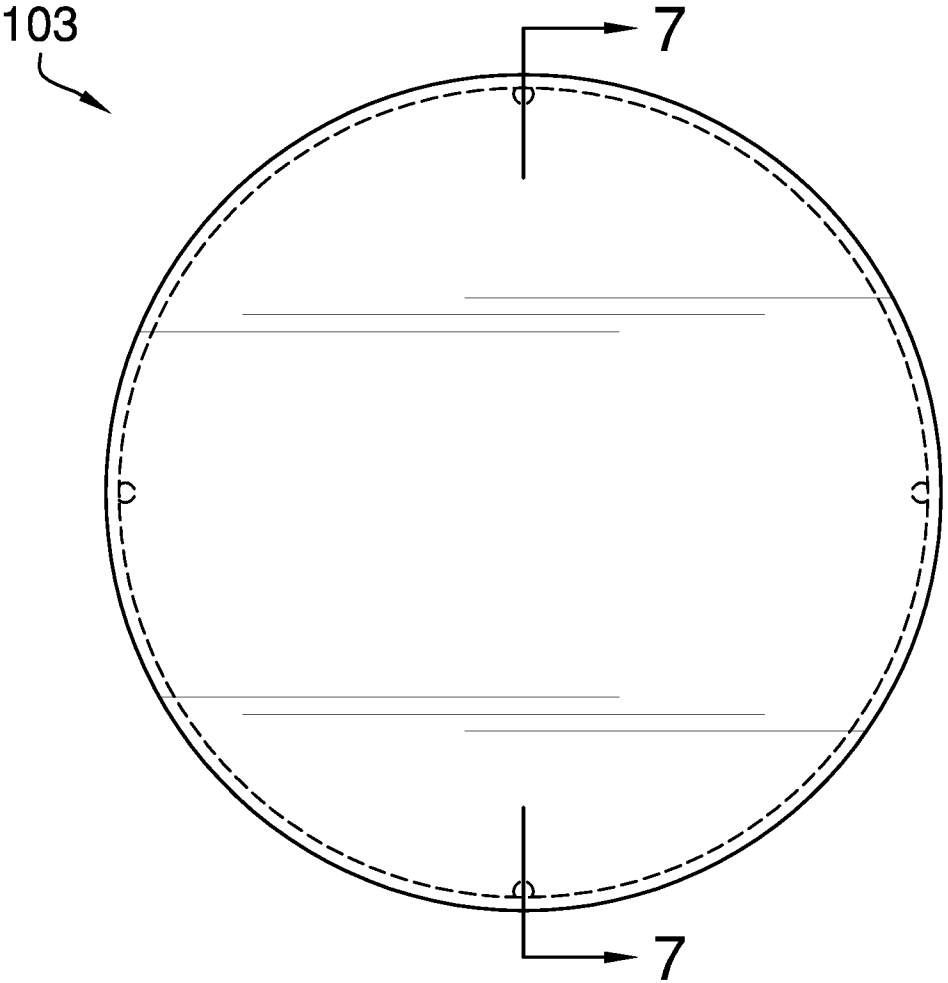
FIG. 6 is a front view of an embodiment of the disclosure.
Figure 8:
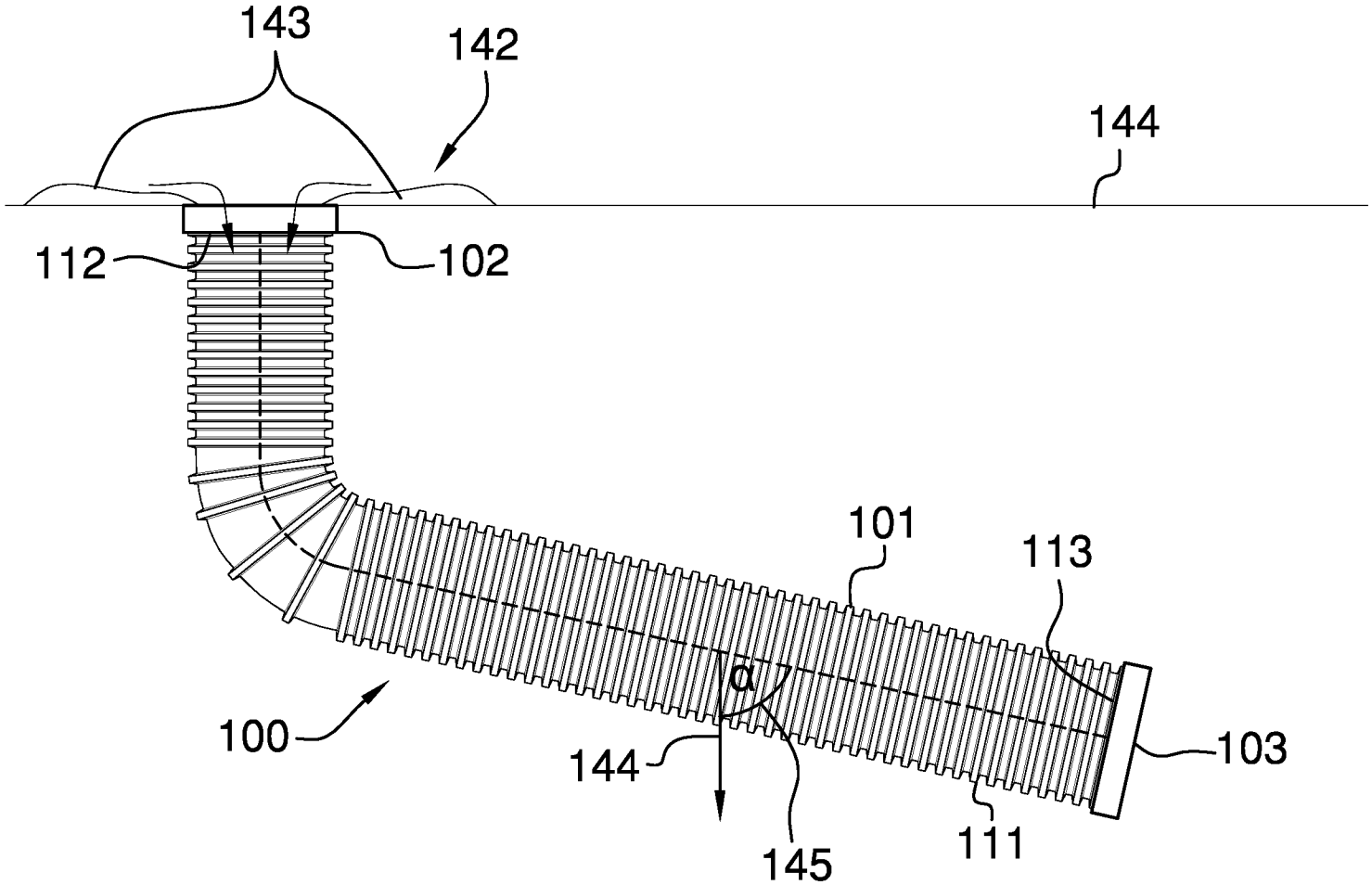
FIG. 8 is an in-use view of an embodiment of the disclosure.

Detailed reference will now be made to one or more potential embodiments of the disclosure, which are illustrated in FIGS. 1 through 8.

The drain pipe end debris cap 100 (hereinafter invention) is a mechanical structure. The invention 100 is adapted for use in the drainage of soil. The invention 100 is a fluid transfer structure that: a) drains water 143 that collects at a collection point 142; b) transports the drainage water 143 underneath the ground 141; and, c) disperses the drainage water 143 into the ground 141. The invention 100 comprises a fluid permeable tubular structure 101, a filter cap 102, and a closing cap 103. The filter cap 102 and the closing cap 103 enclose the open ends of the fluid permeable tubular structure 101 to prevent debris from accumulating within the fluid permeable tubular structure 101.

The ground 141 is defined elsewhere in this disclosure. The collection point 142 is the location where the fluid permeable tubular structure 101 receives the drainage water 143. The drainage water 143 refers to water that accumulates at the collection point 142.

The fluid permeable tubular structure 101 is a roughly prism-shaped structure. The fluid permeable tubular structure 101 has a tube structure. The lateral face of the prism structure of the fluid permeable tubular structure 101 is fluid permeable. The fluid permeable tubular structure 101 is a bimodal flexible structure. The lateral face of the prism structure of the fluid permeable tubular structure 101 resists deformation by radial forces that are applied to the lateral face in the direction towards the center axis of the prism structure of the fluid permeable tubular structure 101. The fluid permeable tubular structure 101 is deformable into a non-Euclidean prism structure.

The fluid permeable tubular structure 101 is buried underneath the ground 141. The fluid permeable tubular structure 101 transports drainage water 143 received at a collection point 142 away from the collection point 142. The fluid permeable tubular structure 101 disperses the received drainage water 143 through the lateral face of the prism structure of the fluid permeable tubular structure 101 into the ground 141.

The fluid permeable tubular structure 101 is buried such that the center axis of the prism structure of the fluid permeable tubular structure 101 forms a cant 145 relative to the force of gravity 144. The force of gravity 144 is defined elsewhere in this disclosure. The cant 145 refers to an angle that is formed between the center axis of the prism structure of the fluid permeable tubular structure 101 and the force of gravity 144. The cant 145 ensures that the drainage water 143 flows from the receiving end 112 of the fluid permeable tubular structure 101 to the terminating end 113 of the fluid permeable tubular structure 101.

The fluid permeable tubular structure 101 comprises a plurality of flow channels 111, a receiving end 112, and a terminating end 113.

Each of the plurality of flow channels 111 is a structure that is formed in the lateral face of the prism structure of the fluid permeable tubular structure 101. Each of the plurality of flow channels 111 forms a fluidic channel that allows water to flow from the interior space of the fluid permeable tubular structure 101 through the lateral face of the prism structure of the plurality of flow channels 111 into the ground 141.

The receiving end 112 is a congruent end of the prism structure of the fluid permeable tubular structure 101. The receiving end 112 is the open end of the fluid permeable tubular structure 101. The receiving end 112 forms a fluidic connection with the collection point 142 such that any drainage water 143 that accumulates at the collection point 142 drains into the receiving end 112. The receiving end 112 is positioned relative to the drainage water 143 such that gravity feeds the flow of drainage water 143 into the receiving end 112.

The terminating end 113 is a congruent end of the prism structure of the fluid permeable tubular structure 101. The terminating end 113 is the congruent end of the prism structure of the fluid permeable tubular structure 101 that is distal from the receiving end 112. The terminating end 113 is terminated by the closing cap 103 such that drainage water 143 will not flow through the terminating end 113.

The filter cap 102 is a prism-shaped structure. The filter cap 102 has a tube structure. The filter cap 102 is a fluid permeable structure. The filter cap 102 is geometrically similar to the fluid permeable tubular structure 101 such that the receiving end 112 of the fluid permeable tubular structure 101 inserts into the filter cap 102. The filter cap 102 encloses the receiving end 112 of the fluid permeable tubular structure 101. The filter cap 102 forms a filter that: a) allows drainage water 143 to enter the receiving end 112; while b) preventing debris at the collection point 142 from entering the receiving end 112. The filter cap 102 comprises an enclosing tube 121 and a surface filter 122.

The enclosing tube 121 is a prism-shaped structure. The enclosing tube 121 is a disk-shaped structure. The enclosing tube 121 has a tube shape. The enclosing tube 121 is geometrically similar to the receiving end 112 of the fluid permeable tubular structure 101 such that the receiving end 112 inserts into the enclosing tube 121.

The surface filter 122 is a filter structure that encloses the face of the disk structure of the enclosing tube 121 that is distal from the terminating end 113 of the fluid permeable tubular structure 101. The surface filter 122 is defined elsewhere in this disclosure. The surface filter 122 is a mesh structure that allows drainage water 143 to flow into the receiving end 112 of the fluid permeable tubular structure 101. The surface filter 122 mounts on the congruent end of the disk structure of the filter cap 102 that is distal from the closing cap 103. The mesh structure of the surface filter 122 forms a barrier that prevents debris from flowing into the receiving end 112 of the fluid permeable tubular structure 101.

The closing cap 103 is a prism-shaped structure. The closing cap 103 has a pan structure. The closing cap 103 encloses the terminating end 113 of the fluid permeable tubular structure 101. The closing cap 103 forms a fluid impermeable seal with the terminating end 113 of the fluid permeable tubular structure 101. The closing cap 103 encloses the terminating end 113 of the fluid permeable tubular structure 101. The closing cap 103 comprises an open face 131 and a closed face 132.

The open face 131 is the open face 131 of the pan structure of the closing cap 103. The open face 131 is geometrically similar to the terminating end 113 of the fluid permeable tubular structure 101 such that the terminating end 113 inserts into the open face 131. The closed face 132 is the closed face 132 of the pan structure of the closing cap 103. The closed face 132 is the congruent end of the prism structure of the closing cap 103 that is distal from the open face 131. The closed face 132 forms a fluid impermeable seal with the terminating end 113 of the fluid permeable tubular structure 101.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Armor: As used in this disclosure, armor refers to a rigid structure used to form a guard that creates a protected space.

Barrier: As used in this disclosure, a barrier is a physical obstacle that forms a boundary between a first space and a second space. The barrier prevents the passage of an object between the first space and the second space.

Bimodal Flexible Structure: As used in this disclosure, a bimodal flexible structure is a structure that: a) responds to forces that are applied to one or more dimensional axes of the bimodal flexible structure in the manner of a rigid structure; while, b) simultaneously responding to forces that are applied to a dimensional axis that is perpendicular to the one or more dimensional axes described in (a) in the manner of a semi-rigid structure with an inelastic nature. A conduit structure is an example of a bimodal flexible structure. Specifically, a conduit structure acts as a rigid structure to forces that are applied in a radial direction towards the center axis of the prism structure of the conduit structure while being allowing the prism structure of the conduit to bend such that the conduit can be shaped into a non-Euclidean prism. A drafting spline is another example of a bimodal flexible structure. The resistance of a wire to compressive forces along the center axis of the wire allows a wire to behave as a bimodal flexible structure.

Cant: As used in this disclosure, a cant is an angular deviation from one or more reference lines (or planes) such as a vertical line (or plane) or a horizontal line (or plane).

Cap: As used in this disclosure, a cap is a protective structure that encloses a space, opening, or fitting.

Capped Tube: As used in this disclosure, a capped tube is a tube with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar. Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Conduit Structure: As used in this disclosure, a conduit structure is an armor structure. The armor structure formed by the conduit structure protects the hollow interior of the conduit structure. The conduit structure forms a flexible hollow tubular prism-shaped structure. The conduit structure is a composite prism structure formed from a plurality of rigid tubular structures. Any first rigid tubular structure selected from the plurality of rigid tubular structures inserts into a second rigid tubular structure such that the second rigid tubular structure rotates relative to the first rigid tubular structure in a manner that allows a cant to be formed between the center axis of the first rigid tubular structure and the center axis of the second rigid tubular structure. Each of the plurality of rigid tubular structures are assembled as a daisy chain in the manner described above. The rigid nature of each of the plurality of rigid tubular structures protects the interior structure of conduit structure from radial forces that are applied directly to any rigid tubular structure selected from the plurality of rigid tubular structures. The ability of any two rigid tubular structures selected from the plurality of rigid tubular structures to rotate relative to each other provides the conduit with a flexible nature that allows the conduit structure to form a non-Euclidean prism structure by curving the center axis of the composite prism structure. The conduit structure is considered a flexible structure with an inelastic nature. The modulus of deformation of the flexible nature of the conduit structure is controlled by controlling the friction caused by the rotation of the second rigid tubular structure within the first rigid tubular structure. The conduit structure is an example of a bimodal flexible structure.

Correspond: As used in this disclosure, the term correspond is used as a comparison between two or more objects wherein one or more properties shared by the two or more objects match, agree, or align within acceptable manufacturing tolerances.

Corrugated: As used in this disclosure, the term corrugated describes a structure that is formed with a series of parallel and alternating ridges and grooves.

Daisy Chain: As used in this disclosure, daisy chain is a term that describes a series of objects that are linked together in a linear fashion. When referring to an electrical circuit, a daisy chain refers to a collection of electrical circuits interconnected using a series circuit.

Debris: As used in this disclosure, debris refers to an accumulation of loose and unwanted material on a surface.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Drain: As used in this disclosure, a drain is a mechanical structure that uses gravity to remove a fluid from a space.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Nature: As used in this disclosure, an elastic nature refers to a flexible structure that returns to its relaxed shape after the flexible structure has been deformed.

Flexible: As used in this disclosure, flexible refers to an object or material that will deform when a force is applied to it but that will not necessarily return to its original shape when the deforming force is removed.

Filter: As used in this disclosure, a filter is a mechanical device that is used to separate solids that are suspended in a liquid or a gas. A strainer is a type of filter with what would be considered a coarse mesh measurement.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Gas: As used in this disclosure, a gas refers to a state (phase) of matter that is fluid and that fills the volume of the structure that contains it. Stated differently, the volume of a gas always equals the volume of its container.

Liquid: As used in this disclosure, a liquid refers to a state (phase) of matter that is fluid and that maintains, for a given pressure, a fixed volume that is independent of the volume of the container.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Ground: As used in this disclosure, the ground is a solid supporting surface formed by the Earth. The term level ground means that the supporting surface formed by the ground is roughly perpendicular to the force of gravity.

Inelastic Nature: As used in this disclosure, an inelastic nature refers to a flexible structure that maintains its new shape after the flexible structure has been deformed.

Mesh: As used in this disclosure, the term mesh refers to an openwork fabric made from threads, yarns, cords, wires, or lines that are woven, knotted, or otherwise twisted or intertwined at regular intervals. Synonyms for mesh include net. A mesh structure formed from metal bars or wires is often referred to as a grate.

Negative Space: As used in this disclosure, negative space is a method of defining an object through the use of open or empty space as the definition of the object itself, or, through the use of open or empty space to describe the boundaries of an object.

Non-Euclidean Prism: As used in this disclosure, a non-Euclidean prism is a prism structure wherein the center axis of the prism lies on a non-Euclidean plane or is otherwise formed with a curvature.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Perimeter: As used in this disclosure, a perimeter is one or more curved or straight lines that bounds an enclosed area on a plane or surface. The perimeter of a circle is commonly referred to as a circumference.

Phase: As used in this disclosure, phase refers to the state of the form of matter. The common states of matter are solid, liquid, gas, and plasma.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space;, b) maintains an environment suitable within the protected space that is appropriate for the object; or, c) protects the object within the protected space from potential dangers that are outside of the protected space.

Relaxed Shape: As used in this disclosure, a structure is considered to be in its relaxed state when no shear, strain, or torsional forces are being applied to the structure.

Roughly: As used in this disclosure, roughly refers to a comparison between two objects. Roughly means that the difference between one or more parameters of the two compared objects are not significantly different.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Surface Filter: As used in this disclosure, a surface filter is a type of filter wherein the fluid is passed through a surface or membrane, such as a screen or paper that allows for the passage of the fluid but blocks the passage of larger particles that may be suspended in the fluid. The construction of a surface filter would allow for the passage of the fluid through several filter surfaces in one filtration unit.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. The drain pipe end debris cap comprising a fluid permeable tubular structure, a filter cap, and a closing cap;

wherein the filter cap and the closing cap attach to the fluid permeable tubular structure;

wherein the fluid permeable tubular structure comprises a plurality of flow channels, a receiving end, and a terminating end;

wherein each of the plurality of flow channels is a structure that is formed in the lateral face of the fluid permeable tubular structure;

wherein the receiving end is a congruent end of the fluid permeable tubular structure;

wherein the terminating end is a congruent end of the fluid permeable tubular structure;

wherein the closing cap has a pan structure;

wherein the closing cap encloses the terminating end of the fluid permeable tubular structure;

wherein the closing cap forms a fluid impermeable seal with the terminating end of the fluid permeable tubular structure;

wherein the closing cap encloses the terminating end of the fluid permeable tubular structure;

wherein the filter cap comprises an enclosing tube and a surface filter;

wherein the surface filter is a filter structure that encloses the face of the disk structure of the enclosing tube that is distal from the terminating end of the fluid permeable tubular structure.

2. The drain pipe end debris cap according to claim 1 wherein the drain pipe end debris cap is a mechanical structure;

wherein the drain pipe end debris cap is adapted for use in the drainage of soil;

wherein the drain pipe end debris cap is a fluid transfer structure that: a) drains water that collects at a collection point; b) transports the drainage water underneath the ground; and, c) disperses the drainage water into the ground.

3. The drain pipe end debris cap according to claim 2 wherein the filter cap and the closing cap enclose the open ends of the fluid permeable tubular structure to prevent debris from accumulating within the fluid permeable tubular structure.

4. The drain pipe end debris cap according to claim 3 wherein the fluid permeable tubular structure has a tube structure;

wherein the lateral face of the fluid permeable tubular structure is fluid permeable;

wherein the fluid permeable tubular structure is a bimodal flexible structure;

wherein the lateral face of the fluid permeable tubular structure resists deformation by radial forces that are applied to the lateral face in the direction towards the center axis of the fluid permeable tubular structure;

wherein the fluid permeable tubular structure is deformable into a non-Euclidean structure.

5. The drain pipe end debris cap according to claim 4 wherein the fluid permeable tubular structure is buried underneath the ground;

wherein the fluid permeable tubular structure transports drainage water received at a collection point away from the collection point;

wherein the fluid permeable tubular structure disperses the received drainage water through the lateral face of the fluid permeable tubular structure into the ground.

6. The drain pipe end debris cap according to claim 5 wherein the fluid permeable tubular structure is buried such that the center axis of the fluid permeable tubular structure forms a cant relative to the force of gravity;

wherein the cant refers to an angle that is formed between the center axis of the fluid permeable tubular structure and the force of gravity.

7. The drain pipe end debris cap according to claim 6 wherein the filter cap encloses the receiving end of the fluid permeable tubular structure;

wherein the filter cap forms a filter that: a) allows drainage water to enter the receiving end; while b) preventing debris at the collection point from entering the receiving end.

8. The drain pipe end debris cap according to claim 7 wherein each of the plurality of flow channels forms a fluidic channel that allows water to flow from the interior space of the fluid permeable tubular structure through the lateral face of the plurality of flow channels into the ground.

9. The drain pipe end debris cap according to claim 8 wherein the receiving end is an open end of the fluid permeable tubular structure;

wherein the receiving end forms a fluidic connection with the collection point such that any drainage water that accumulates at the collection point drains into the receiving end;

wherein the receiving end is positioned relative to the drainage water such that gravity feeds the flow of drainage water into the receiving end.

10. The drain pipe end debris cap according to claim 9 wherein the terminating end is the congruent end of the fluid permeable tubular structure that is distal from the receiving end;

wherein the terminating end is terminated by the closing cap such that drainage water will not flow through the terminating end.

11. The drain pipe end debris cap according to claim 10 wherein the filter cap has a tube structure;

wherein the filter cap is a fluid permeable structure;

wherein the filter cap is geometrically similar to the fluid permeable tubular structure such that the receiving end of the fluid permeable tubular structure inserts into the filter cap.

12. The drain pipe end debris cap according to claim 11 wherein the enclosing tube is a disk-shaped structure;

wherein the enclosing tube has a tube shape;

wherein the enclosing tube is geometrically similar to the receiving end of the fluid permeable tubular structure such that the receiving end inserts into the enclosing tube.

13. The drain pipe end debris cap according to claim 12 wherein the surface filter is a mesh structure that allows drainage water to flow into the receiving end of the fluid permeable tubular structure;

wherein the surface filter mounts on the congruent end of the disk structure of the filter cap that is distal from the closing cap;

wherein the mesh structure of the surface filter forms a barrier that prevents debris from flowing into the receiving end of the fluid permeable tubular structure.

14. The drain pipe end debris cap according to claim 13 wherein the closing cap comprises an open face and a closed face;

wherein the open face is the open face of the pan structure of the closing cap;

wherein the open face is geometrically similar to the terminating end of the fluid permeable tubular structure such that the terminating end inserts into the open face;

wherein the closed face is the closed face of the pan structure of the closing cap;

wherein the closed face is the congruent end of the closing cap that is distal from the open face of the closing cap;

wherein the closed face forms a fluid impermeable seal with the terminating end of the fluid permeable tubular structure.

* * * * *